United States Patent [19]

Newbert

[11] 4,216,598

[45] Aug. 12, 1980

[54] RELEASABLY SECURABLE DOOR KNOB TAG

[76] Inventor: Richard B. Newbert, Hickory Dr., Amherst, N.H. 03031

[21] Appl. No.: 843,823

[22] Filed: Oct. 20, 1977

[51] Int. Cl.[2] ..... G09F 3/04

[52] U.S. Cl. ..... 40/331; 40/20 R; 40/617

[58] Field of Search ..... 40/10 C, 19.5, 20 R, 40/331, 617, 599, 20, 2 R

[56] References Cited

U.S. PATENT DOCUMENTS

| | | | |
|---|---|---|---|
| 1,272,394 | 7/1918 | Devney | 40/331 |
| 1,276,735 | 8/1918 | Devney | 40/331 |
| 1,790,157 | 1/1931 | Kovary | 40/20 R X |
| 2,538,927 | 1/1951 | Truitt | 40/20 R X |
| 3,530,543 | 9/1970 | Desmarais et al. | 40/20 R |
| 3,775,882 | 12/1973 | Wheeler | 40/10 C |

FOREIGN PATENT DOCUMENTS

| | | | |
|---|---|---|---|
| 1254544 | 1/1961 | France | 40/316 |

*Primary Examiner*—Louis G. Mancene
*Assistant Examiner*—Wenceslao J. Contreras
*Attorney, Agent, or Firm*—Weingarten, Maxham & Schurgin

[57] ABSTRACT

A wind proof door knob tag especially for use with exterior doors includes integral flexible detent tabs between the opening through which the door knob passes and the opening which conforms to the outside diameter of door knob shaft. The tabs are cammed outwardly upon downward pull over the knob shaft and snap back into position to hold the tag firmly in place on the door knob despite wind conditions, thereby to prevent being blown away. The tab is made of a polyolefin sheet but could be made of a vinyl sheet which at the thickness utilized, prevents unauthorized opening of locks by insertion of this tag between a door and its associated jamb.

11 Claims, 5 Drawing Figures

RELEASABLY SECURABLE DOOR KNOB TAG

FIELD OF INVENTION

This invention relates to door knob tags and more particularly to a method and apparatus for preventing the tags from being dislodged, especially when used on exterior doors exposed to wind.

BACKGROUND OF THE INVENTION

Door knob tags having a round hole through which the door knob protrudes have been commonly in use, with the top of the door knob shaft supporting the tag at the top of the circular hole. While these type of tags are, to a certain extent, satisfactory for interior doors, more and more hotels and motels have been planned with exterior doors either exposed to a courtyard or parking lot. Tags of the above configuration blow off the exterior door knobs and present a major cost to the motel or hotel operator over the course of a year. Slotted tags also exist in which the slot conforms to the outside diameter of the door knob shaft. However, these tags also blow off when used on exterior doors.

The subject invention is a door knob tag which snaps into place. It is formed with two apertures or holes, one large enough to accommodate a knob, the other just large enough to accommodate the knob shaft in a snug fit, and integrally formed inwardly projecting flexible tab portions in a channel or passageway between the two holes. The tag is merely slipped over the knob and pulled down. Initially, during the downward pull, the knob shaft cams the tabs outwardly. When the tag is in place, the tabs snap back. This binds the tag to the knob shaft in a releasable manner and is remarkable in its ability to prevent tag blowaway.

A further feature of the subject tag is that it is too thin to be successfully used to "jimmy" locks by insertion between the door and door jamb. The tag in one embodiment is made either of STACON TM, a polyolefin sheet, (a trademarked product of Central States Products of St. Louis, Missouri) with a thickness ranging between 0.015 and 0.019 inches or a laminated vinyl ranging in thickness of between 0.010 and 0.015 inches which prevents lock tampering.

It is, therefore, an object of this invention to provide a wind proof door knob tag.

It is another object of this invention to provide a method of preventing door knob tags from blowing away.

It is a still further object of this invention to provide a door knob tag material which in predetermined thickness prevents lock tampering.

These and other objects of this invention will be better understood when taken in connection with the following detailed description and accompanying drawings in which:

DETAILED DESCRIPTION

Figure 1:
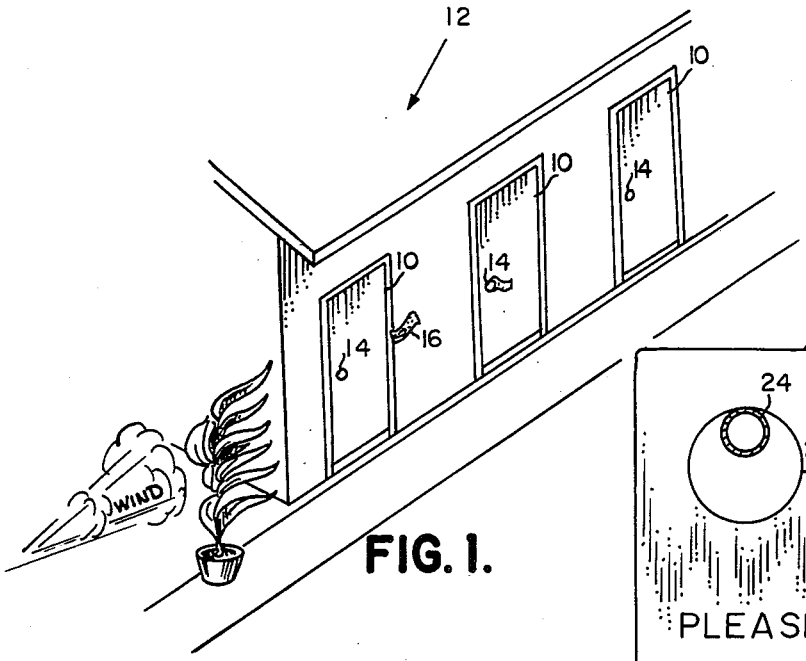
FIG. 1 is a diagrammatic illustration of tag blow off.

Referring now to FIG. 1, a typical exterior door situation is depicted in which exterior doors 10 of a building 12 have knobs 14 to which tags may be affixed. As pictured, in a wind gust the prior art tags pictured in FIGS. 2 and 3 have a tendency to blow off as illustrated by tag 16 in FIG. 1. As mentioned hereinbefore, due to the almost universal use of these tags, their loss is costly.

Figure 2:
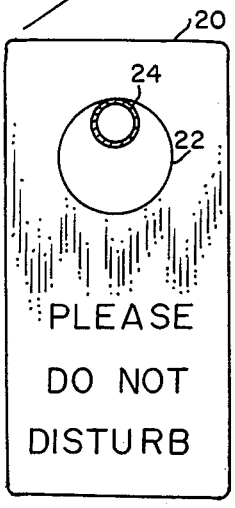
PRIOR ART FIG. 2.
FIGS. 2 and 3 illustrate two prior art tags in plan view.
Figure 3:
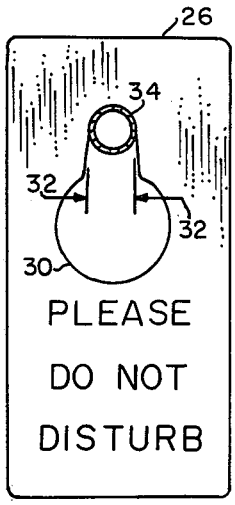
PRIOR ART FIG. 3.

As pictured in FIG. 2 the standard tag 20 has an aperture 22 large enough to accommodate a typical door knob. When in place on the door knob shaft, here shown in cross section at 24, this tag is susceptible to being blown away. Likewise, the slotted tag 26 of FIG. 3 blows off the exterior door knob in the presence of wind gusts. It will be noted that the slot 28 extends from the door knob hole 30 and has a wide aperture as shown by arrows 32 to be that of the outside diameter of the knob shaft 34.

Figure 4:
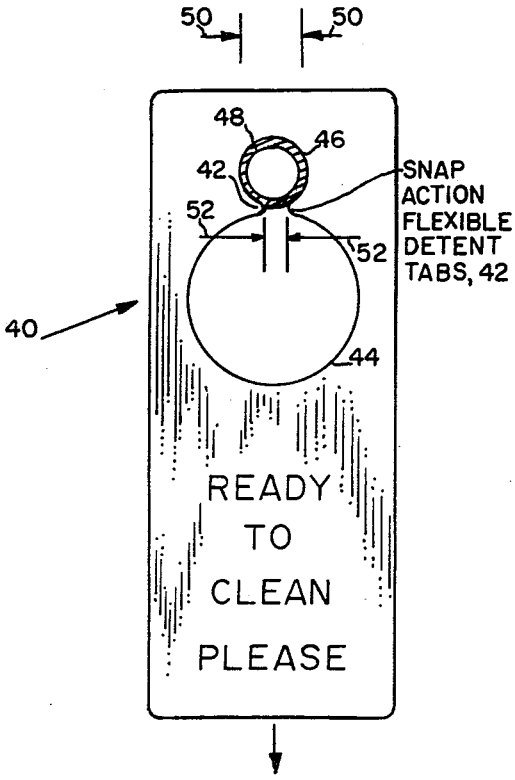
FIG. 4 is a plan view of the subject invention showing the subject flexible detent tabs which prevents tag blow off.

In order to prevent dislodging of the tag by wind as shown in FIG. 4, the subject tag 40 has flexible integral detent tabs 42 placed in a channel or passageway between a door knob hole 44, and a shaft hole 46 therefore. The tabs are rounded in one embodiment to facilitate mounting of the tag to the door knob shaft. Here, the shaft is depicted in cross section at 48. The diameter of hole 46 conforms in a snug fit to the outside diameter of shaft 48 as shown by arrows 50. In one embodiment the tag itself is made of 0.015–0.019 inch STACON TM to prevent lock tampering as shown by arrows 51 in FIG. 5.

The detent tabs are spaced apart by a distance less than the outside diameter of the door knob shaft as illustrated by arrows 52. In one embodiment with 1" door knob shafts, the distance separating the tabs is approximately $\frac{5}{8}$".

Figure 5:
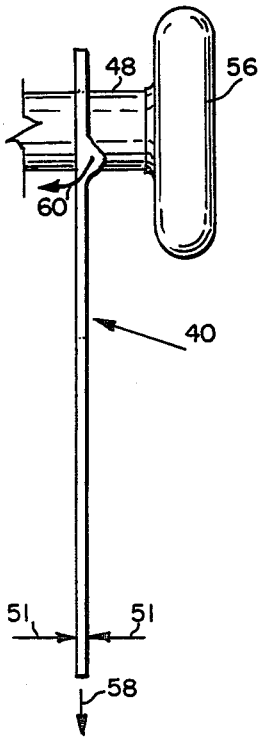
FIG. 5 is a side view of the subject invention showing tab camming when the tag is pulled down into place.

In operation, as shown in FIG. 5, tag 40 is slipped over knob 56 and is pulled down as shown by arrow 58. Tab 42 cams outwardly as illustrated by arrow 60 as it contacts the knob shaft. Thereafter, the tab snaps back into place, eg. returns to the plane of the tag.

When tag 40 is in place, it is held securely to the knob shaft by the snap action of the tabs.

Tags made in this fashion have withstood gale force winds, yet are easily removed by pulling upwardly on the tag. Note that in the illustrated embodiment, the tabs are integral to and of the same material of the tag.

What has therefore been provided is a wind proof tag, which is easily secured to a standard door knob as well as a method for preventing dislodging of door knob tags by wind. Moreover, the tag in one embodiment is made of a material of a resiliency and thickness which prevents its use in opening locked doors.

While particular embodiments of the invention have been described it will be understood that various modifications may be made which fall within the true spirit and scope of the invention claimed.

I claim:

1. A windproof releasably securable door knob tag comprising:

a strip of resilient material forming the body of said tag, said strip having a tabless aperture, the edges of said aperture being spaced from the edges of the body of the tag, said aperture being large enough to accommodate the knob portion of a door knob, a second tabless aperture, the edges of said aperture being spaced from the edges of the body of the tag, said second aperture being of a smaller size than said first aperture, yet of a size to accommodate the shaft of said door knob, and a channel between said two apertures; and, resilient tab means on either side of said channel projecting towards the center of said channel and having a separation less than the outside diameter of said door knob shaft, whereby when said tag is pulled over said door knob shaft in a predetermined direction, said resilient tab means cam outwardly on said door knob shaft and then snap back, thereby to releasably secure said tag to said door knob.

2. The tag of claim 1 wherein said tabs are integral to said tag.

3. The tag of claim 1 wherein said tag is made of polyolefin.

4. The tag of claim 1 wherein said tag is made of vinyl.

5. The tag of claim 1 wherein said tag is made of 0.015–0.019 inch polyolefin.

6. The tag of claim 1 wherein said tag is made of 0.010–0.015 inch vinyl.

7. The tag of claim 1 wherein said tabs are integral to said tag and lie in the same plane as said tag.

8. The tag of claim 1 wherein said second aperture is above said first aperture.

9. The tag of claim 1 wherein the size of said second aperture is such that it forms a snug fit when said tag is in place on said door knob shaft.

10. A method of preventing door knob tags from blowing away comprising:

providing said tag with an aperture of a size to accommodate the knob portion of a door knob assembly, providing said tag with a second aperture of a size to accommodate the shaft of said door knob assembly in a snug fit, and providing a passageway between said apertures of a diameter less than the shaft diameter of said door knob.

11. A windproof releasably secureable door knob tag, comprising:

a strip of resilient material forming the body of said tag, said strip having an aperture large enough to accommodate the knob portion of a door knob, a second aperture of a size to accommodate the shaft of said door knob, and a channel between said two apertures, and rounded resilient tab means on either side of said channel projecting towards the center of said channel and having a separation less than the outside diameter of said door knob shaft.

* * * * *